United States Patent [19]

Johnson

[11] Patent Number: 4,742,664

[45] Date of Patent: May 10, 1988

[54] SNAP-IN GLAZING BEAD

[75] Inventor: Ryne R. Johnson, Ashville, N.Y.

[73] Assignee: Hope's Architectural Products, Inc., Jamestown, N.Y.

[21] Appl. No.: 104,576

[22] Filed: Oct. 2, 1987

Related U.S. Application Data

[63] Continuation of Ser. No. 916,940, Oct. 7, 1986, abandoned.

[51] Int. Cl.[4] ..... E04B 1/60

[52] U.S. Cl. ..... 52/771; 49/501; 52/773

[58] Field of Search ..... 49/501; 52/770, 771, 52/773, 775, 476

[56] References Cited

U.S. PATENT DOCUMENTS

| | | | |
|---|---|---|---|
| 2,813,313 | 11/1957 | Shrode | 52/773 |
| 3,299,596 | 1/1967 | Neal et al. | 52/775 X |
| 3,487,601 | 1/1970 | James | 52/773 X |
| 3,566,570 | 3/1971 | Evans | 52/498 |
| 4,207,717 | 6/1980 | Hubbard | 52/770 X |

*Primary Examiner*—Philip C. Kannan

*Attorney, Agent, or Firm*—Larson and Taylor

[57] ABSTRACT

A snap-in apparatus for securing a glass to a window frame includes a glazing bead retainer secured to the window frame having at least one generally horizontal retaining flange. A generally L-shaped substantially rigid glazing bead includes a generally horizontal projection disposed between the horizontal surface of the retainer and the glass provides a snap-in engagement between the glazing bead and the retainer. A substantially vertical window retaining flange portion of the L-shaped glazing bead is provided at one end of the horizontal projection.

5 Claims, 2 Drawing Sheets

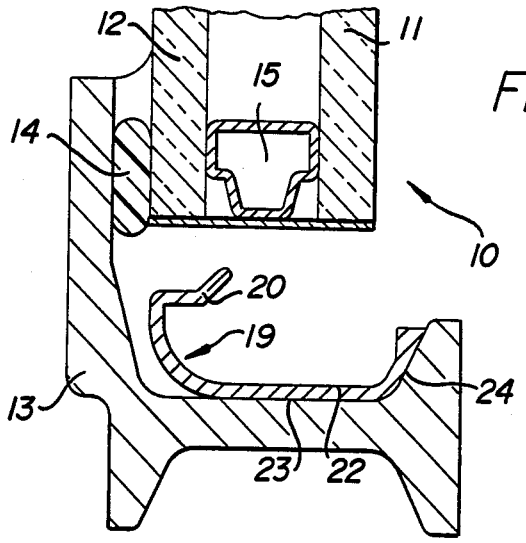
FIG.3
FIG.4
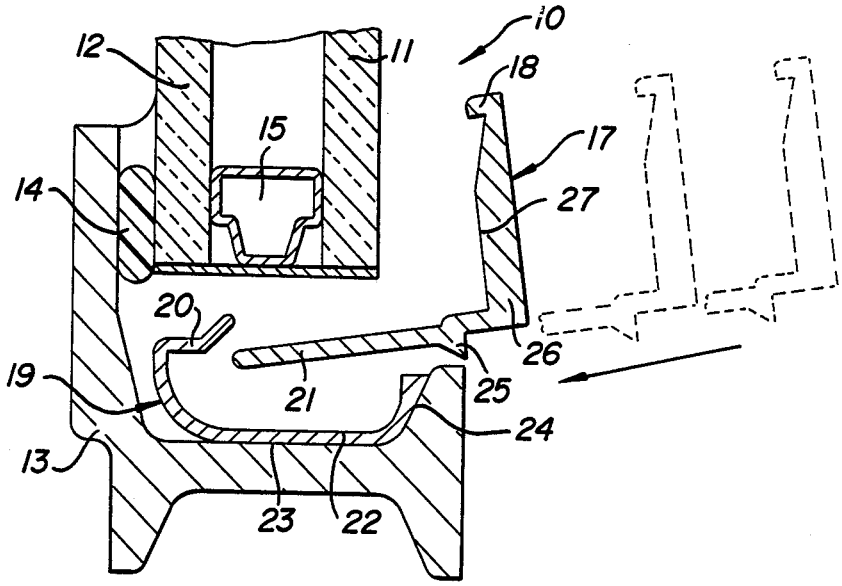
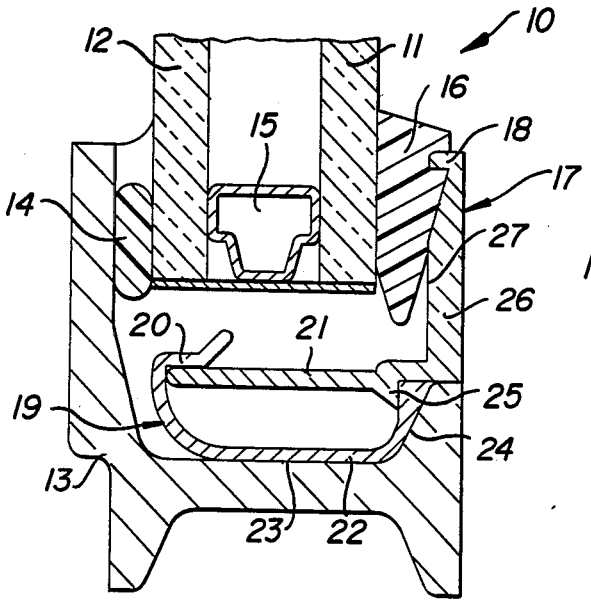
FIG.5

SNAP-IN GLAZING BEAD

This application is a continuation of application Ser. No. 916,940 filed Oct. 7, 1986, now abandoned.

FIELD OF THE INVENTION

The present invention relates to snap-in apparatus for mechanically retaining glass in window frames.

BACKGROUND OF THE INVENTION

The present invention provides a mechanical means for retaining windows in their frames. Conventional means for retaining glass in their frames employ glazing beads which are attached to window frames by a plurality of mechanical fasteners such as screws or pop-rivets. Glazing beads of this type suffer from two distinct disadvantages. First, they are not aesthetically pleasing since the mechanical fasteners used to attach them are exposed to view. Second, to replace a window all of the mechanical fasteners for that particular glazing bead must be removed by using the appropriate tools. In response to this problem a simple snap-in glazing bead was developed which did not require visible mechanical fasteners. In addition, the new system no longer requires the removal of mechanical fasteners but instead one need only snap the glazing bead out, replace the glass, and snap the glazing bead back in.

Some systems for retaining glass in frames that do not require visible screws or rivets exist in the prior art. U.S.S.R. Patent No. 490,931; British Patent No. 1,455,135; German Patent No. 2,557,708; and U.S. Pat. No. 3,680,276 are examples of such systems. None of these examples includes the superior combination of simplicity in design and utilitarian function embodied in the present invention.

SUMMARY OF THE INVENTION

The present invention relates to a snap-in apparatus for securing a glass to a frame which comprises a glazing bead retainer having at least one generally horizontal retaining flange, means for securing the retainer to a window frame, and a glazing bead. The glazing bead includes a generally horizontal projection for engaging the retaining flange of the glazing bead retainer to hold said bead in a working position, and a substantially vertical window retaining flange having a generally vertical surface for securing a glass into a window frame.

In a preferred embodiment the glazing bead retainer of the invention includes a frame contacting portion which rests on the window frame to aid in securing the retainer in position. The retainer may be secured to the frame by mechanical fasteners or any other feasible securing means and need not be removed to replace the glass. Further, this retainer may be a single continous unit extending the length of the frame or it may comprise several units intermittently spaced along the length of the frame.

The glazing bead snaps into the glazing bead retainer. It may include an additional member depending from the generally horizontal projection for engaging the frame contacting portion of the glazing bead retainer by snap-in engagement.

OBJECTS OF THE INVENTION

The primary object of the present invention is to provide a simple, economical fastener for retaining glass in their frames.

A further object of the present invention is to provide a window glazing bead that is aesthetically pleasing.

A further object of the present invention is to provide a snap-in window glazing bead such that it is simple to remove and replace when replacing glass.

These and other objects of the invention will be apparent from the following detailed description when taken in conjunction with the drawings.

BRIEF DESCRIPTION OF THE DRAWINGS

FIG. 3 is a cross-section of a window construction using the apparatus of the present invention without the glazing bead.

FIG. 4 is a cross-section of a window construction showing the mode of installation of the glazing bead.

FIG. 5 is a cross-section of a window construction having the apparatus of the present invention installed therein.

DETAILED DESCRIPTION OF THE PREFERRED EMBODIMENT

Figures 1, 2:
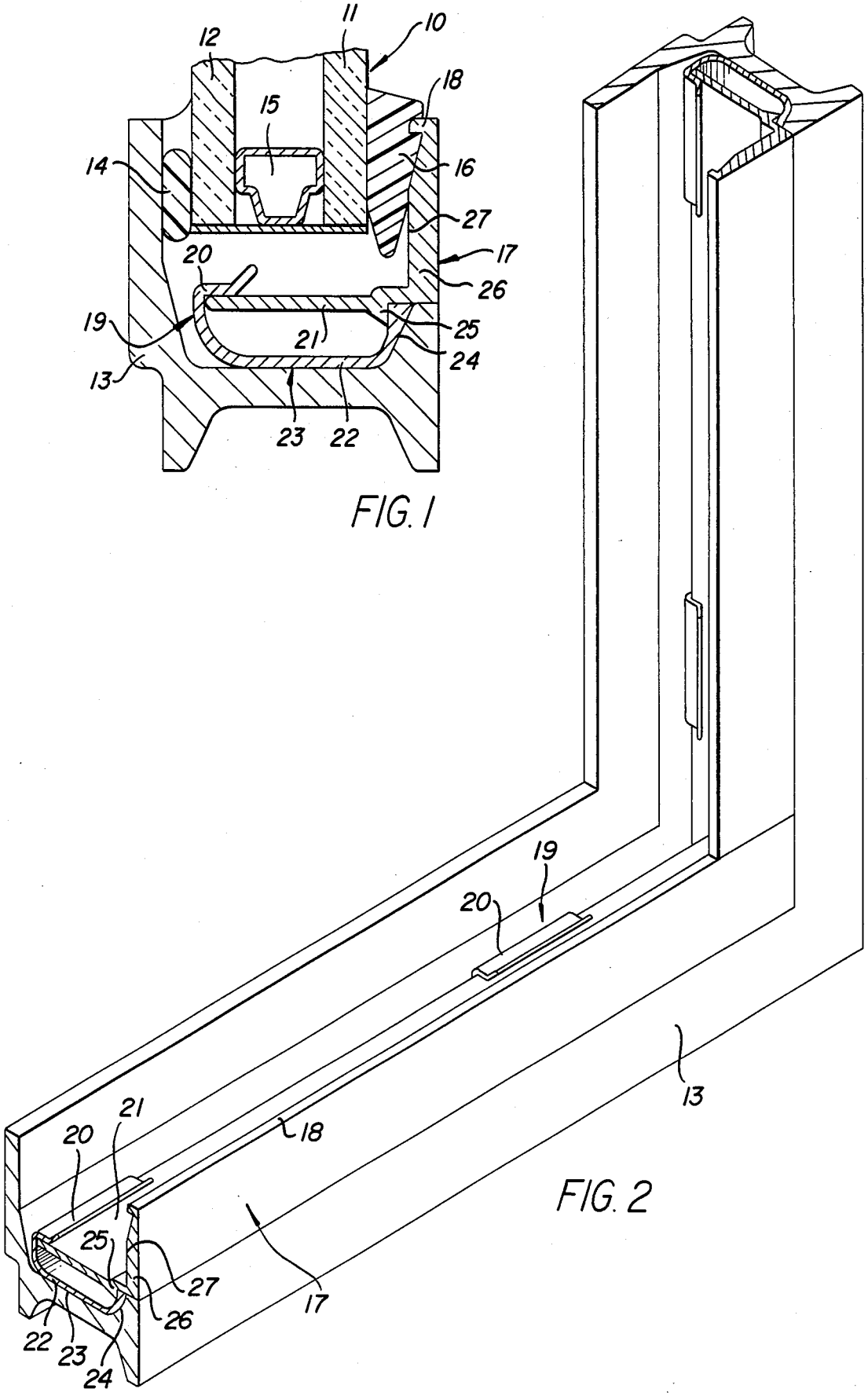
FIG. 1 is a cross-section of a window construction using the apparatus of the present invention.
FIG. 2 is an overall plan view of a window frame, without the window which has the apparatus of the present invention installed thereon.

Referring to FIG. 1 a glass panel 10 comprising two parallel sheets of glass 11, 12 are shown mounted in a window frame 13. A spacer element 14 is mounted between the frame 13 and glass sheet 12. A second spacer element 15 is mounted between the two sheets of glass 11 and 12. A third spacer element 16 is mounted between the sheet of glass 11 and the glazing bead 17.

Glazing bead 17 includes a small protruding member 18 which serves to engage the spacer element 16 and secure it in place against the glass sheet 11. The glazing bead 17 snaps into the glazing bead retainer 19. The retainer 19 includes a retaining flange 20 which engages the horizontal projection 21 of the glazing bead 17. The retainer 19 also includes a frame contacting portion 22 which rests on the frame 13 as shown in the figure. The frame contacting portion 22 has a generally horizontal surface 23 which is secured to the frame 13 by some securing means such as mechanical fasteners (not shown). The frame contacting portion 22 also includes a generally vertical surface 24 which abuts against the inner surface of the lip of the frame 13 to aid in securing the retainer 19 in place on the frame 13.

The glazing bead 17 further includes a generally vertical securing member 25 which depends from the horizontal projection 21. This generally vertical securing member 25 insures that the glazing bead 17 engages the retainer 19 in a snap-in relationship. When the glazing bead 17 is snapped in the securing member 25 will fit snugly into the retainer 19 such that application of a small amount of pressure is required to disengage the glazing bead 17 from the retainer 19. Additionally, the glazing bead 17 also includes a generally vertical window retaining flange 26 that has a generally vertical surface 27 which rests against the third spacer element 16 to indirectly retain the glass sheets 11, 12 in place.

As shown in FIGS. 3–5, in operation the retainer 19 is fastened to the frame 13 at the factory. The frame 13 is installed in a structure and a pair of glass sheets 11, 12 are inserted in the frame 13. The glazing bead 19 is then tipped at an angle from the horizontal and the generally horizontal projection 21 is inserted under the flange 20 of the retainer 19 as shown in FIG. 4. The glazing bead 17 is then snapped into the retainer 19 by applying a sharp rap to the generally vertical window retaining flange 26 and simultaneously tilting the glazing bead 17 to a horizontal position. To remove the glazing bead 17 one applies pressure to the window retaining flange 26 and lifts upon the glazing bead 17.

The retainer 19 may consist of a continuous piece that runs the length of the frame 13 or may be composed of short lengths spaced intermittently along the frame 13 as shown in FIG. 2. The retainer 19 may be welded to the frame 13 or attached by mechanical fasteners. The retainer 19 may be fabricated from either ferrous or non-ferrous metal, or plastics. The glazing bead 17 is preferably made of aluminum although other metallic or plastic materials may be satisfactory.

Various modifications of the window securing apparatus described above may be made within the spirit of this invention and all such changes falling within the scope of the following claims are embraced thereby.

I claim:

1. A snap-in apparatus for securing glass to a window frame comprising:

a resilient glazing bead retainer having at least one generally horizontal retaining flange capable of being displaced and having a generally horizontal surface;

means for securing said generally horizontal surface of said retainer to a generally smooth window frame between the window frame and the glass such that a midplane of the glass intersects said generally horizontal surface; and a generally L-shaped, substantially rigid glazing bead including a generally horizontal projection disposed between said horizontal surface of said retainer and the glass such that the midplane of the glass also intersects said generally horizontal projection for displacing said retaining flange of said retainer to provide a snap-in engagement between said glazing bead and said retainer, and a substantially vertical window retaining flange provided at one end of said horizontal projection having a generally vertical surface for securing the glass into the window frame.

2. An apparatus in accordance with claim 1 wherein said glazing bead further comprises:

a generally vertical securing member depending from said generally horizontal projection for engaging said glazing bead retainer by snap-in engagement such that said glazing bead is maintained in said glazing bead retainer.

3. An apparatus in accordance with claim 1 wherein said glazing bead retainer comprises a plurality of short lengths intermittently spaced along the length of the window frame.

4. An apparatus in accordance with claim 1 further comprising a protruding member at a free end of said vertical window retaining flange which protrudes parallel to said horizontal projection; and a spacer element adapted to fit securely between said vertical window retaining flange and the glass, said spacer element being attached to said protruding member by snap-in engagement.

5. An apparatus in accordance with claim 1 wherein the other end of said horizontal projection of said L-shaped member engages beneath said retaining flange of said retainer on the opposite side of the midplane of the glass from said generally vertical surface of said L-shaped glazing bead.

* * * * *